US010751899B2

(12) United States Patent
Lischinski et al.

(10) Patent No.: US 10,751,899 B2
(45) Date of Patent: Aug. 25, 2020

(54) FEEDING APPARATUS

(71) Applicant: Weber Maschinenbau GmbH Breidenbach, Breidenbach (DE)

(72) Inventors: Gerd Lischinski, Schonbeck (DE); Tobias Weber, Biedenkopf-Wallau (DE); Sigfrid Bauer, Grob-Tetzleben (DE)

(73) Assignee: Weber Maschinenbau GmbH Breidenbach (DE)

( * ) Notice: Subject to any disclaimer, the term of this patent is extended or adjusted under 35 U.S.C. 154(b) by 146 days.

(21) Appl. No.: 15/157,309

(22) Filed: May 17, 2016

(65) Prior Publication Data

US 2016/0339597 A1 Nov. 24, 2016

(30) Foreign Application Priority Data

May 18, 2015 (DE) ..... 10 2015 107 716

(51) Int. Cl.

| | |
|---|---|
| ***B26D 1/143*** | (2006.01) |
| ***B26D 7/06*** | (2006.01) |
| ***B26D 1/25*** | (2006.01) |
| ***B26D 7/01*** | (2006.01) |
| ***B26D 7/18*** | (2006.01) |

(52) U.S. Cl.

CPC ..... *B26D 7/0683* (2013.01); *B26D 1/143* (2013.01); *B26D 1/25* (2013.01); *B26D 7/01* (2013.01); *B26D 7/018* (2013.01); *B26D 7/0608* (2013.01); *B26D 7/0625* (2013.01); *B26D 7/1845* (2013.01); *B26D 2007/011* (2013.01); *B26D 2210/02* (2013.01)

(58) Field of Classification Search

CPC ..... B26D 7/0683; B26D 1/143; B26D 1/25; B26D 7/01; B26D 7/018; B26D 7/0608; B26D 7/0625; B26D 7/1845

See application file for complete search history.

(56) References Cited

U.S. PATENT DOCUMENTS 2,801,662 A * 8/1957 Brunnier ..... A23N 15/003 83/409.2
4,321,847 A 3/1982 Dillon
4,505,173 A 3/1985 Hartlage
(Continued)

FOREIGN PATENT DOCUMENTS

DE 3239178 A1 4/1984
DE 69502687 T2 2/1999
(Continued)

OTHER PUBLICATIONS

Extended German search report for related German application No. 102015107716.7, dated: Apr. 18, 2016, pp. 8.
(Continued)

*Primary Examiner* — Andrea L Wellington
*Assistant Examiner* — Liang Dong
(74) *Attorney, Agent, or Firm* — Dickinson Wright PLLC

(57) ABSTRACT

The invention relates to a feeding apparatus for feeding food products to a slicing unit, having a product support comprising at least one track for the reception of a plurality of products arranged one after another; and at least one product mount which comprises a holder for holding a rear end of a product viewed in a feed direction.

5 Claims, 7 Drawing Sheets

(56) References Cited

U.S. PATENT DOCUMENTS

Figure 1:
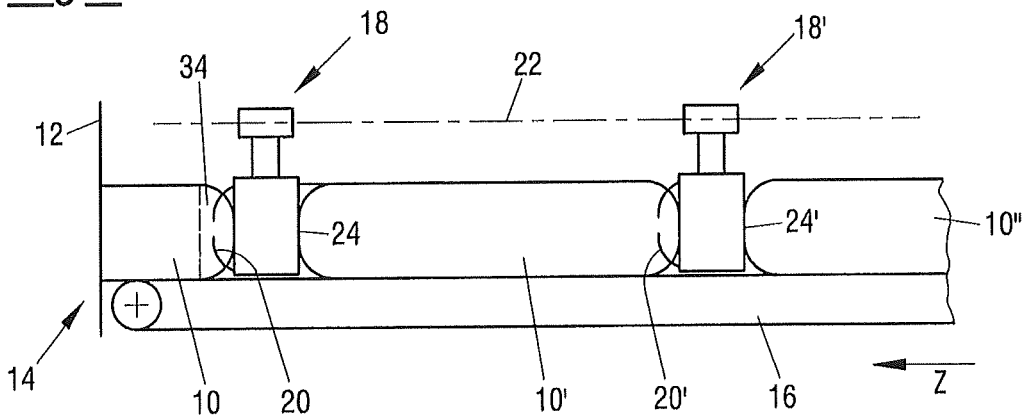

| | | | | |
|---|---|---|---|---|
| 4,583,435 | A * | 4/1986 | Fessler | B26D 7/01 83/277 |
| 8,360,229 | B2 | 1/2013 | Janning | |
| 2005/0132855 | A1* | 6/2005 | Weber | B26D 9/00 83/155 |
| 2010/0257984 | A1* | 10/2010 | Scaroni | B26D 7/14 83/13 |
| 2012/0042757 | A1* | 2/2012 | Weber | B26D 5/20 83/23 |
| 2012/0297944 | A1* | 11/2012 | Maddaleni | B26D 3/16 83/23 |
| 2015/0202786 | A1* | 7/2015 | Mayer | B26D 7/02 83/13 |

FOREIGN PATENT DOCUMENTS

| | | | |
|---|---|---|---|
| DE | 20218439 | U1 | 1/2003 |
| EP | 0930137 | A2 | 7/1999 |
| EP | 2273508 | A1 | 1/2011 |
| GB | 505821 | A | 5/1939 |
| GB | 2386317 | A | 9/2003 |
| JP | 2008173700 | A | 7/2008 |

OTHER PUBLICATIONS

European Patent Office Search Report dated Oct. 18, 2016 for European Patent Application No. EP 16 16 9372, 1 page.

* cited by examiner

FEEDING APPARATUS

The invention relates to a feeding apparatus, to a slicing apparatus as well as to a feeding method for feeding food products to a slicing unit. The food products can in particular be formed as bars. The products can, for example, be sausage, ham, cheese, meat, bread or the like.

The feeding apparatus has a product support comprising at least one track for the reception of a plurality of products arranged one after another. The product support can be configured for a single-track or multi-track mode of operation. In a multi-track mode of operation, a plurality of products can, for example, be fed to a common slicing unit in parallel to and next to one another.

The feeding apparatus comprises at least one product mount which comprises a holder for holding a rear end of a product viewed in a feed direction.

Product mounts are generally known. They can in particular be configured as grippers and can engage into an end region of a product. The product can accordingly be stabilized during the slicing mode of operation.

A product mount is respectively known from the documents EP 0 930 137 B1 and U.S. Pat. No. 4,505,173, with each product mount respectively holding a product during the slicing mode of operation and subsequently being moved back outside a feed region for the products.

A disadvantage of previous feeding apparatus is that the product mount is always only associated with the product which is currently being sliced. Following products are, in contrast, only detected by the product mount when the preceding product has been completely sliced.

This has the result that pauses, for example, occur in the slicing mode of operation, since the product mount first has to engage into the following product and displace said product to the slicing unit. However, a product flow or portion flow, i.e. the flow of cut-off slices grouped to form portions, which is as continuous as possible is in particular striven for with high-performance slicers having a packaging apparatus which is connected downstream. The pauses in the product flow, in particular due to the loading with new products, however, stand in the way of a continuous mode of operation. The shorter the products to be sliced are, the higher the proportion of loading pauses is. The loading pauses necessitate the use of buffer paths, in particular additional buffer paths, in the region of conveying paths and/or sorting paths after the slicing unit. Due to the buffer paths, the total length of the slicing apparatus increases, which is in particular disadvantageous in view of the limited space at the customer.

Guide apparatus are furthermore necessary with a product which is not held by a product mount, in order to feed the product to the slicing unit.

In addition, a complex sensor system is required in order to determine the exact position of the following product, in particular of the product start. However, such a system is associated with increased costs.

It is therefore an object of the invention to provide a feeding apparatus, a slicing apparatus as well as feeding methods by which a following product can also be guided securely in addition to the product which is currently being sliced.

The object is satisfied by feeding apparatus, by a slicing apparatus as well as by feeding methods having the respective features of the independent claims. In accordance with an aspect of the invention, the product mount comprises an abutment for a front end of a following product in addition to a holder for holding the rear end of the product viewed in the feed direction.

The product mount satisfies a dual function. For example, the side which faces the slicing unit is used to hold the product, on the one hand. On the other hand, the rear side of the product mount which is remote from the slicing unit is also used in order to form an abutment for the following product. The following product is pressed toward the abutment and contacts it. The abutment can in particular comprise a passive abutment surface.

In accordance with an embodiment, at least two product mounts are provided per track. A further product mount can thus engage into the rear end of the following product and can push the product toward the abutment of the front product mount. The following product can in this manner be guided securely between the two product mounts.

The invention also relates to a feeding apparatus for feeding food products to a slicing unit, having a product support comprising at least one track for the reception of a plurality of products arranged one after another; and at least two product mounts per track which each comprise a holder for holding a rear end of a product viewed in the feed direction.

Accordingly, a plurality of product mounts are provided per track which are in particular arranged one after another in the feed direction. Precisely two, precisely three or precisely four product mounts can in particular be provided per track.

The product mounts can be of the same design or different designs and can e.g. differ with respect to their functionality and/or their shape.

The product mounts can preferably be controlled independently of one another by means of a control. The product mounts of different tracks can also, for example, be controlled individually and independently of one another.

The products which are present in different tracks and/or in the same track can be fed individually to a slicing unit. The feeding speed can in particular be set individually.

The product mounts can each hold different products of a track. In principle, it is, however, also possible that the same product is held by a plurality of product mounts, in particular by two product mounts, as long as the slicing has not yet started at said product.

A plurality of products are preferably, at least provisionally, simultaneously held by a respective product mount. The products which are guided one after another in the same track can therefore be fed securely to the slicing unit.

If a preceding product is completely sliced, the product mount can be adjusted from within a feed region in order not to impede the following product. Since the following product is already in engagement with a product mount, it can be advanced toward the slicing unit without time loss. Pauses in the slicing mode of operation can be minimized in this manner.

In accordance with an embodiment, the product mounts each comprise an abutment for a front end of a following product. The product mount can thus hold a preceding product and can also serve as an abutment for a following product. This following product is likewise held by a product mount which, in turn, can in particular itself have an abutment for a further following product at its side remote from the slicing unit. The product is accordingly securely fed to the slicing unit between a holder of the product mount and an abutment of the preceding product mount. In this moved together position, the product length can therefore also be determined with reference to the positions of the two product mounts. The measured result can be processed in the control.

The feeding apparatus in accordance with the invention is suitable both for a single-track mode of operation and for a multi-track mode of operation. In a multi-track mode of operation, a plurality of products are arranged next to one another. The tracks can in particular extend in parallel in this respect. A track having one or more product mounts can in particular be configured as a module. The tracks can be expanded as desired. For example, it is in particular possible to convert a single-track mode of operation into a multi-track mode of operation. An expansion of a two-track mode of operation into a three-track or four-track mode of operation is, for example, also conceivable. The number of tracks is generally not restricted.

It is advantageous with respect to a modular design if one or more separate product mounts are associated with each track. The product mount can in particular be connected directly or indirectly, for example via a common frame, to the product support.

The holder of the product mount generally holds a product and can in particular cooperate with the rear end of the product. The holder can preferably be brought into engagement with the product end. A gripper can thus e.g. be provided as a holder. This gripper can comprise claws which engage into the product end. Alternatively, a vacuum gripper is, for example, conceivable which holds the product end with the aid of a generated vacuum.

The product support can be a conveyor belt, for example. The product support can also be configured as a loading rocker which can be adjusted from a loading position which is at least substantially horizontal and in which the loading rocker is loaded with products into an inclined slicing position in which the products are sliced. For example, a common loading rocker in which a feed belt comprises the total width can be provided for a plurality of tracks. Alternatively, feeding systems having individual, track-specific arrangements are also possible.

It is furthermore also possible that the product support comprises transport movers of a transport system which is also called a magnetic conveying system in the following. A generally usable magnetic conveying system, to which reference is expressly made herewith, is provided by the company MagneMotion Inc., domiciled in Devens, Mass., USA. This system is based on a so-called LSM drive, that is on a drive by linear synchronous motors, which is to be distinguished from a so-called linear induction motor (LIM drive). In contrast to a LIM drive, a magnetic field is not induced by means of the so-called electromagnetic traveling field in an LSM drive, but rather the magnetic field is made available by permanent magnets. If the rotor of the linear motor supports the permanent magnets and the stator of the linear motor generates the electromagnetic traveling field, the drive principle of an LSM drive can thus in figurative terms be imagined to be such that the transporter provided with the permanent magnet is drawn over the transport path by the magnetic field which moves along the stator. Such a transport system respectively drive principle is, for example, described in WO 2003/029651 A2 and WO 2010/085670 A1. Reference is herewith expressly made to these documents with respect to the disclosure of a possible drive principle or functional principle for the invention.

In such a transport system, separate transport movers can be moved on a track system. A product to be conveyed can in this respect be fed on a transport mover to a slicing unit. A plurality of transport movers arranged one after another can in this respect, for example, form the product support. A product mount can in this respect in particular engage between two movers.

In accordance with the invention, a following product can be securely guided in addition to a product which is currently being sliced. A quasi-continuous loading is also achieved so that only short loading pauses, if any, occur. A very uniform portion flow is thereby achieved. This only requires a relatively small effort with respect to the buffer paths in the region of the conveying paths and sorting paths after the slicing unit and considerably simplifies the total design of the plant.

It is furthermore ensured that the products can be fed very precisely and at narrow spacings. The shorter the products to be sliced are and the higher the proportion of loading processes is in relation thereto, the more advantageous the design in accordance with the invention will be.

Further developments of the invention are set forth in the dependent claims, in the description and in the enclosed drawings.

In accordance with an embodiment, the product mount is configured to fix and/or to determine the position of the following product, in particular of the product start. The product mount therefore satisfies a further object, since it can be used to determine the position of the following product. This in particular takes place with the aid of a control. The control can, for example, measure a power increase at the drive of the product mount if e.g. the front end of the product has arrived at the abutment during the advance. Additional sensors or the like are consequently not required in order to determine the position. The positions of products of different tracks can in particular be fixed and/or determined in a track-specific manner.

In accordance with a further embodiment, an abutment of the product mount comprises an abutment surface which is at least substantially planar and/or which is adapted to the shape of the front end of the following product. In this respect, the product can, for example, have an end face which is at least substantially planar from the start. It is also possible to already slice the front end piece of the following product in a straight manner in advance, e.g. in a peeling machine. In this way, the following product can contact the abutment surface in a flush manner. The product can thus be sliced immediately as soon as the preceding product has been completely sliced and the associated product mount has been moved out of the feed region.

In accordance with a further embodiment, the product mount comprises a further holder for holding a front end of a following product. The product mount can accordingly form both an abutment and a holder, at least a provisional holder, for the following product. The holder in particular acts or points against the feed direction and can e.g. be extended, folded outwardly and/or pivoted outwardly, in particular also from the abutment surface.

A connection, at least a provisional connection, can preferably be established between the preceding product and the following product. The holder can in particular be configured in the manner of a cramp. A plurality of products can thus so-to-say be fed together as a unit to a slicing unit. If the preceding product is almost completely sliced, the connection to the following product can be released again in order to be able to remove the product mount from the feed region.

The holder between the product currently to be sliced and the following product can in particular only have the additional holder which faces against the feed direction, while the product mount which holds the rear end of the following product can only have a holder which faces the feed direction.

In accordance with a further embodiment, the product mount and/or an abutment of the product mount is/are configured as variable in length in the feed direction. The length can preferably be adjusted automatically in operation. The length adjustment can in particular take place electrically, mechanically, pneumatically and/or hydraulically.

The length adjustment in particular serves for the length compensation on the adjustment of the product mount from the feed region. The front product mount can be retracted by a specific dimension in order to generate a spacing from the following product. A certain clearance thereby results in order to be able to remove the product mount. Subsequently, the following product can in turn be displaced to the front by the same dimension. For this purpose, the length of the product mount of the following product can in particular likewise be made variable. The respective product mounts are in particular adjustable by a predefined dimension and/or by a predefinable dimension which is known to the control or which can be input via the control.

In accordance with a further embodiment, a guide device is provided for the product mount by means of which the product mount can be guided in parallel to the feed direction. The product mount can in particular be moved in and against the feed direction. A plurality of product mounts can preferably be associated with a common guide. The product mounts can in particular also be moved on a common track, preferably of a magnetic conveying system. A plurality of product mounts are preferably associated with a single track. The guide can in particular extend at the side of and/or above the product support. The guide can in particular at least substantially extend over the length of the product support.

In accordance with a further embodiment, the product mount and/or the guide device comprises/comprise an adjustment apparatus which is configured to adjust the product mount, in particular the holder, from within a feed region. The product mount can in particular be adjusted away from the product support with the aid of the adjustment apparatus. The product mount is preferably adjusted from within the flow of the fed products or from within the normal working position. The path is thus clear for the following products. The adjustment apparatus can in particular be configured to adjust the product mount from within the feed region by means of a stroke movement, an oscillating movement, a transverse movement and/or a rotary movement.

In accordance with a further embodiment, the product mount and/or the holder is/are releasably connected or connectable to the guide device. A permanent connection to the guide device is not absolutely necessary. The product mount and/or the holder can in particular be automatically connected to the guide unit and/or can be automatically released from said guide unit. The product mount and/or the holder can preferably be transferred from guide means to guide means. The guide means can revolve in this respect. A magnetic conveying system can preferably be provided which comprises a ring-shaped track guide. In the region of the product support, the track guide can in this respect extend in parallel to the product support.

In accordance with a further embodiment, a separate guide device and/or a separate drive is/are associated with each product mount. The guide devices can in particular be displaced in parallel to one another and/or can be arranged at different sides of the product support. Whereas e.g. a product mount which is associated with a guide device which is at the left with respect to the product support holds a first product which is currently being sliced, a further product mount which is associated with a right guide device can already hold a following product. As soon as the product has been sliced up to an end piece, the left product mount can be moved back. The left product mount can in this respect be moved beyond the following product against the feed direction in order finally to hold a further product. In this respect, a disposal of the end piece can take place on the return path.

A "paddling system" is so-to-say present, wherein the product mounts of a track can respectively be brought into an alternating engagement with the products. These ensure the advance and/or the stabilization of the products. The drives for the product mounts can, for example, be linear drives.

In accordance with a further embodiment, the holders of two product mounts are configured to at least temporarily hold the rear end of the same product viewed in the feed direction. The two product mounts can in particular hold the product at different sides. The holders can also, for example, engage into one another, e.g. in the manner of a rake. The two product mounts can thus in particular complement one another to form a complete product mount. Taken alone, each of the product mounts can also only form one half. The product mounts can thus hold a product together until said product is at least substantially completely sliced. In this respect, only a single product mount is also sufficient for holding the end piece so that a product mount can already be returned to hold a following product.

In accordance with a further embodiment, at least one of the product mounts is connected to a tractor unit and/or is integrated into a tractor unit. The lateral space requirements are e.g. thereby minimized. The guide device of a product mount can in particular be provided at the tractor belt or within the traction device which acts on the product from above, whereas the guide device of a further product mount can be arranged above the tractor belt.

In accordance with a further embodiment, the holder can be pivoted and/or can be displaced relative to an axis which is parallel or perpendicular to the feed direction. In particular when a plurality of product mounts engage at the same product, one of the product mounts can, for example, be pivoted out to the side in order to be moved back to hold a following product. A pivoting toward an axis which is perpendicular to the feed direction can, in contrast, be advantageous in order to remove the holder from the feed region in a tight space. The holder can in particular be folded upwardly together with the end piece.

The invention also relates to an apparatus for slicing food products, in particular to a high-performance slicer, having a slicing unit which comprises at least one cutting blade which moves in a rotating and/or peripheral manner in a cutting mode of operation. The cutting blade can in particular be a circular blade or a scythe-like blade. The slicing apparatus furthermore comprises a feeding apparatus in accordance with the invention. A plurality of products can in particular also be sliced at the same time with the aid of the same cutting blade.

The slicing apparatus in accordance with the invention has the advantage that the following products can also be guided securely. In addition, a modular expansion by any desired number of parallel tracks is also possible on the basis of the association of the product mounts with the respective tracks.

The invention furthermore relates to a method for feeding food products to a slicing unit having a feeding apparatus in accordance with the invention. First, a plurality of products arranged one after another are received at the product support which comprises at least one track. The holder of the product mount holds a rear end of a product viewed in the feed direction, whereas a front end of a following product contacts an abutment of the product mount.

Finally, the invention also relates to a method for feeding food products to a slicing apparatus having a feeding apparatus in accordance with the invention, wherein a plurality of products arranged one after another are received at the product support which comprises at least one track, wherein at least two product mounts are provided per track, with the holders of said product mounts each holding a rear end of a product viewed in the feed direction.

While the front product is being sliced, the following product is in this respect in particular detected by a further product mount and is pressed toward the abutment of the preceding product mount. The following product can thus be guided and positioned securely. The exact position of the front product end of the following product can also be determined with the aid of the preceding product mount. The length of the usable part of the product bar can be likewise determined from the positions of the two product mounts so that the control can calculate and divide slices and portions.

In accordance with an embodiment, the holder holds the rear end of the product until the product is sliced up to an end piece. The holder is subsequently pivoted and/or displaced relative to an axis which is perpendicular to the feed direction. The holder can in particular be folded upwardly. The holder then dispenses the end piece. This can, for example, be effected in that the end piece is conveyed into a discharge chute.

Subsequently, or also prior to and/or during the dispensing of the end piece, the product mount and/or the holder is/are adjusted in parallel to and against the feed direction and then holds/hold a rear end of a following product. The holder can in particular engage into the product end in this respect.

All the embodiments of the apparatus described here are in particular configured to be operated in accordance with one or more of the methods described here. Furthermore, all of the embodiments of the apparatus described here as well as all of the embodiments of the methods described here can respectively be combined with one another.

Figure 2:
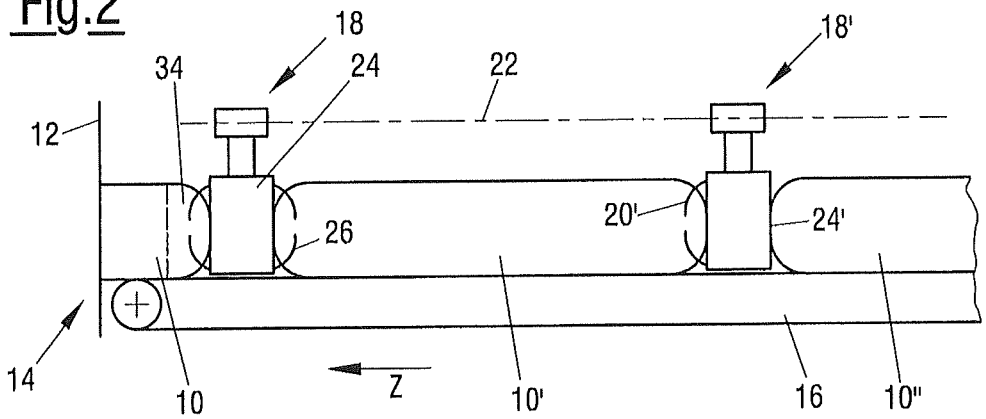
Figure 3:
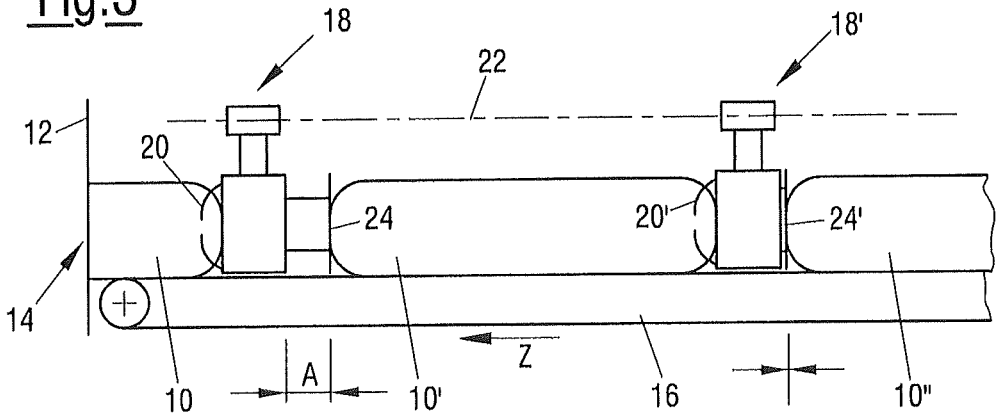
Figure 4:
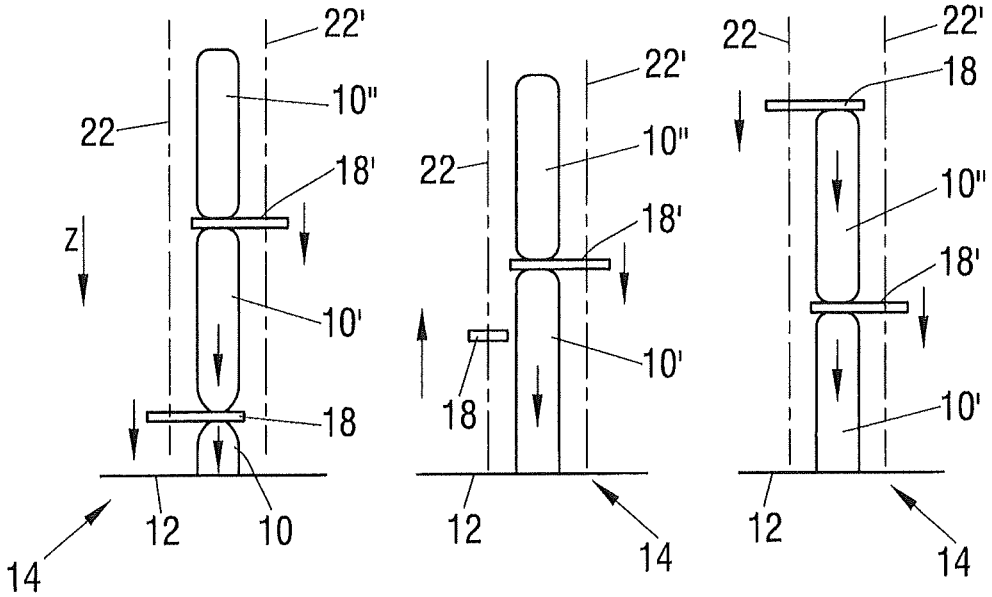
Figure 5:
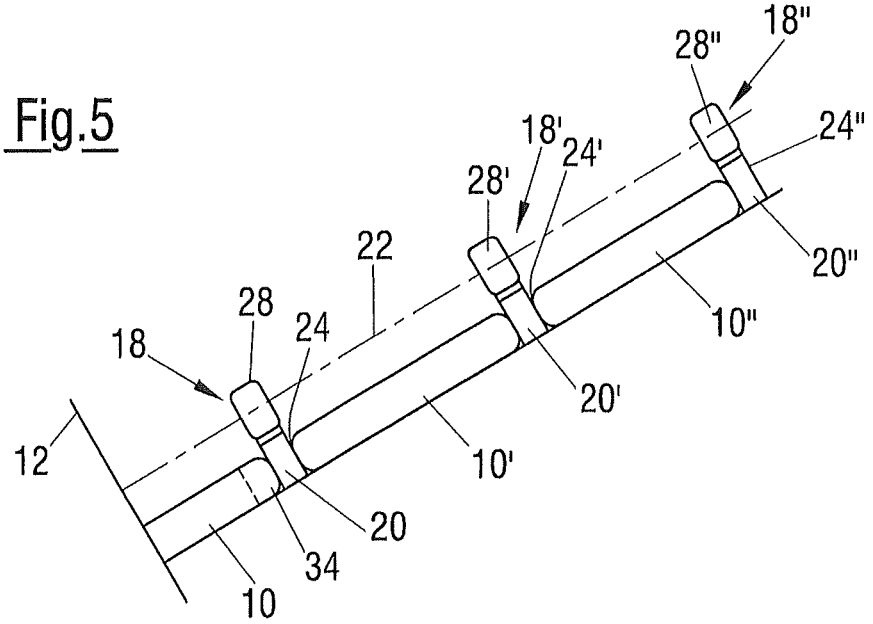
Figure 6:
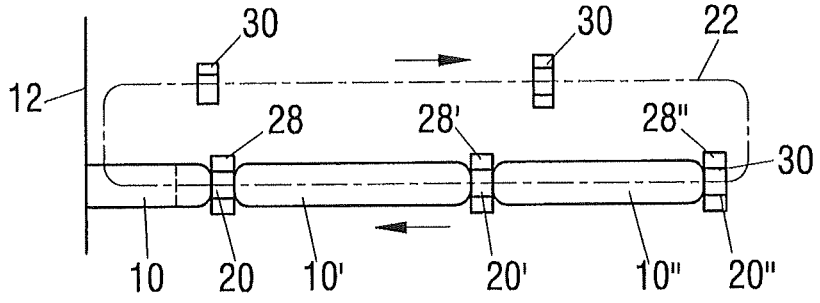
Figure 7:
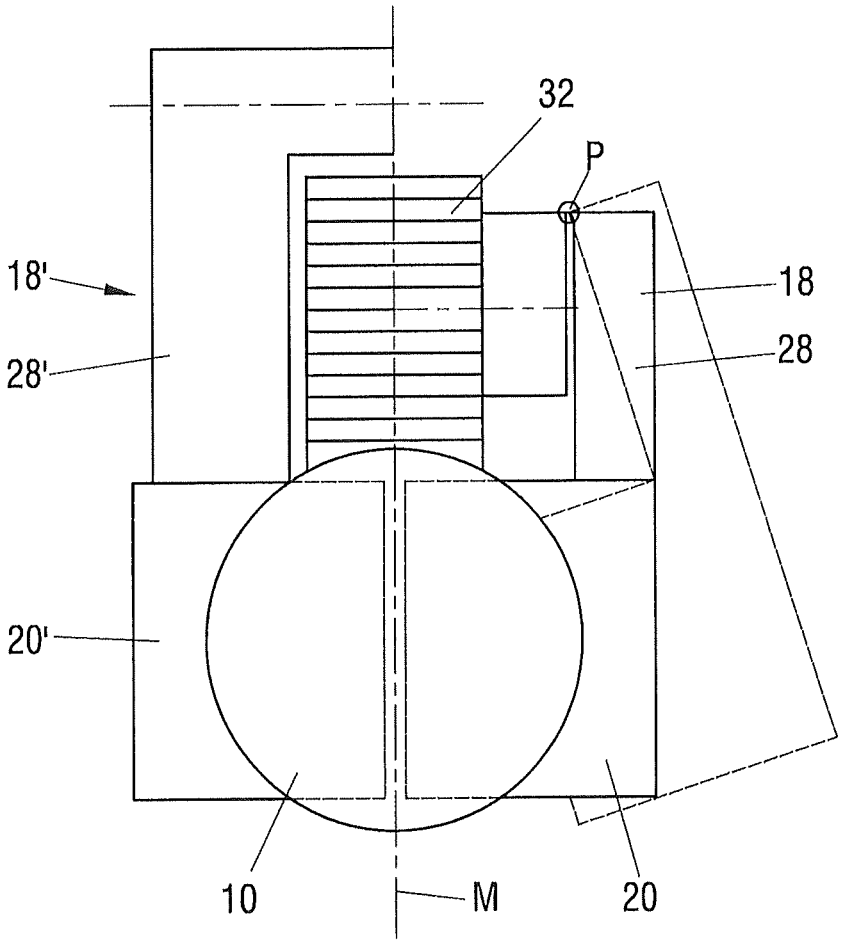

The invention will be described in the following by way of example with reference to the drawings. There are shown:

FIG. 1 a side view of an embodiment of a feeding apparatus in accordance with the invention;

FIG. 2 a side view of a further embodiment of a feeding apparatus in accordance with the invention;

FIG. 3 a side view of a further embodiment of a feeding apparatus in accordance with the invention;

FIG. 4 plan views of a further embodiment of a feeding apparatus in accordance with the invention;

FIG. 5 a side view of a further embodiment of a feeding apparatus in accordance with the invention;

FIG. 6 a plan view of a further embodiment of a feeding apparatus in accordance with the invention;

FIG. 7 a front view of a further embodiment of a feeding apparatus in accordance with the invention; and FIGS. 8A to 8G perspective views of a further embodiment of a feeding apparatus in accordance with the invention.

First, it is found that the embodiments shown are purely of an exemplary nature. The number of the tracks and product mounts shown can in particular vary. The features of an embodiment can also be combined in any desired manner with features of a different embodiment. The product mounts and/or functionalities shown can in particular also be used in the respective other embodiments.

FIG. 1 shows a feeding apparatus which feeds food products 10, 10', 10" in the feed direction Z to a cutting blade 12 having a slicing unit 14. The products 10, 10', 10" are in this respect present at a product support 16 which is shown as a conveyor belt by way of example. The products 10, 10', 10" are held at their respective ends with the aid of product mounts 18, 18'. The product mounts 18, 18' are in particular configured as grippers in which the holders 20, 20' each comprise claws which engage into the ends of the products 10, 10'. Alternatively to claws, the product mounts 18, 18' can also comprise a vacuum device, for example.

The product mounts 18, 18' are guided at a common guide device 22. Alternatively, it is also possible that a separate guide device 22 is associated with each product mount 18, 18'.

The product mounts 18, 18' are preferably connected to the guide device 22 from above or from the side. The fastening of a product mount 18, 18' to a product 10, 10', 10" in particular takes place such that the product mount 18, 18' moves into a region above the product support 16 for the products 10, 10', 10" by a stroke movement, an oscillating movement, a transverse movement and/or a rotary movement and thus comes into engagement with the product 10, 10', 10".

The product mount 18, 18' can equally be removed from the region above the product support 16 for the products 10, 10', 10" by a stroke movement, an oscillating movement, a transverse movement and/or a rotary movement if a held product 10, 10', 10" is completely sliced up to an end piece 34. The end piece 34 can remain connected to the holder 20, 20' and should be cast off outside the product support 16 as far as possible and should subsequently be led away. In this respect, a resulting gap in the conveyor belt can in particular be used when the product support 16 which is e.g. configured as a loading rocker is pivoted downwardly. The product mount 18, 18' can be moved against the feed direction Z in order subsequently to grip a following product 10, 10".

The rear sides of the respective product mounts 18, 18' are configured as abutments 24, 24' for following products 10, 10". Each abutment 24, 24' comprises an abutment surface for a product 10', 10" detected by a following product mount 18'. While the first product 10 is being sliced, the second product 10' is pressed by the product mount 18' toward the abutment 24 of the preceding product mount 18 and can thus be gripped.

The rear side of the product mount 18 in this respect serves as a passive abutment 24 for the following product 10'. Accordingly, the rear side of the product mount 18' in turn also serves as an abutment 24' for the further product 10".

In this manner, the product starting position can be fixed so that the position, the shape and the portion division of a product 10, 10', 10" can be taken into account for the slicing mode of operation. The product 10, 10', 10" can in particular already be measured in front of the loading range in order to fix a later division into portions.

In the embodiment shown in FIG. 2, the product mount 18 comprises a cramp 26 as a holder 20. The abutment 24 of the product mount 18 consequently also has a holder for the following product 10' which acts against the feed direction Z. The abutment 24 thus not only comprises a passive abutment surface, but also a holder or at least a further holding functionality. As is shown, a system configured in such a manner can establish a connection, at least a temporary connection, between the remainder of the product 10 and the following product 10'. The cramp 26 which is configured against the feed direction Z can in particular be removed from the front end of the product 10', e.g. it can be folded away or retracted in order to move the product mount 18 out of the feed region.

The cramp 26 can preferably be provided at the product mount 18 between the first product 10 and the second product 10', whereas a normal product mount 18' can be inserted between the second product 10' and the third product 10".

Due to the cramp-like connection in accordance with FIG. 2 between the products 10, 10', these products 10, 10' can more or less be moved as a unit.

The embodiment shown in FIG. 3 comprises the product mounts 18, 18' which are configured as variable in length. The holders 20, 20' or the abutments 24, 24' can in particular be adjusted along the feed direction Z. This in particular serves for the length compensation on the removal or on the moving of the product mounts 18, 18' out of the region of the product support 16.

The product mount 18, in particular the holder 20 or the abutment 24, can be retracted by a predefined dimension A. In this manner, sufficient space is provided in order to be able to remove the product mount 18 from the feed region. As soon as the holder 20 has been removed from the region of the product support 16, the following product 10' will be advanced in the feed direction Z by exactly this dimension A. The product mount 18' which is in engagement with the following product 10' can in particular for this purpose be moved apart by exactly this dimension A. The product 10' is then immediately in the correct position and can be sliced.

The front end of the respective products 10, 10', 10" can preferably be sliced in a straight manner as a preparatory measure so that a reference surface arises at which the usable region of the product 10, 10', 10" starts. This reference surface can contact the rear side of the product mount 18, 18' at the associated abutment surface of the abutment 24, 24'. The straight cutting off of the front end piece can, for example, take place in a peeling machine, not shown, which is arranged upstream.

In the embodiment shown in FIG. 4, different guide devices 22, 22' are associated with the respective product mounts 18, 18'. These guide devices 22, 22' are displaced in parallel to one another. Whereas, for example, the product mount 18 of the left guide devices 22 holds the first product 10 during the slicing mode of operation, the product mount 18' at the right guide device 22' already grips the end of the second product 10'. As soon as the second product 10' is sliced, the left product mount 18' can be retracted. This is a kind of "paddling system" in which a product mount 18, 18' is always in alternating engagement with a product 10, 10', 10" and ensures the advance and/or the stabilization of the respective product 10, 10', 10".

For this purpose, the respective product mount 18, 18' which becomes free is, for example, moved out of the working position by 90° so that a retraction is possible next to the product support 16. The product mount 18, 18' thus does not impede the feeding of the food products 10, 10', 10" to the cutting blade 12.

In the embodiment in accordance with FIG. 5, the product mounts 18, 18', 18" are made in two parts. The product mounts 18, 18', 18" in this respect comprise holders 20, 20', 20" as well as guide means 28, 28', 28". The rear sides of the holders 20, 20', 20" can also serve as abutments 24, 24', 24".

The holders 20, 20', 20" are respectively connected or connectable to the guide means 28, 28', 28" via releasable connections. These connections are in turn associated with the guide device 22 which ensures the movement along the product support 16 in the feed region.

The holders 20, 20', 20" remain at the products 10, 10', 10" and are transferred from a guide means 28, 28', 28" to the next respective guide means 28, 28', 28". The guide means 28, 28', 28" revolve about the guide device 22. This can in particular take place in a track-specific manner, i.e. a guide device 22 is associated with each track. If a product 10, 10', 10" is completely sliced, the holder 20, 20', 20" is again connected to the guide means 28, 28', 28" and is taken along. The end pieces 34 are then removed. The holders 20, 20', 20" are in this connection or subsequently again adjusted against the feed direction Z so that they again arrive behind a new product 10, 10', 10" and hold said product.

This application is in particular suitable for the use in a magnetic conveying system. This is shown in FIG. 6. The movers 30 in this respect serve as guide means 28, 28', 28" and revolve about the guide device 22 configured as a magnetic track. The movers 30 can at least temporarily be connected to the holders 20, 20', 20" in order to hold the products 10, 10', 10".

In addition to decouplable holders 20, 20', 20", holders 20, 20', 20" which are rigidly connected to the movers 30 are also conceivable.

As shown in FIG. 5 and FIG. 6, a plurality of product mounts 18, 18', 18" can move at a common guide device 22. These product mounts can be associated with at least one track in a feed region and can extend in parallel to said track.

The guide device 22 extends substantially at the side of and/or above the product support 16 for the products 10, 10', 10". The product mounts 18, 18', 18" in the proximity of the cutting blade 10 are thus moved out of the feed region as soon as the last portion or slice is sliced. The product mounts 18, 18', 18" can subsequently again be transferred into a rear feed region in order there to take over a following product 10, 10', 10".

Depending on the number of product mounts 18, 18', 18" associated with a track, the following product 10, 10', 10" can be the next, the next adjacent or the next-next adjacent product 10, 10', 10" depending on the length of the product support 16 and depending on the length of the products 10, 10', 10". More than two products 10, 10', 10" can thus also be arranged positioned in front of one another or one after another in a row on a track in the feed region. This is in particular possible when the products 10, 10', 10" are comparatively short.

In accordance with the embodiment shown in FIG. 7, the product mounts 18, 18' can be configured differently and at least temporarily engage at the same product 10. One of the product mounts 18 can be connected to a tractor unit 32 or can be integrated into the tractor unit 32. A further product mount 18' can, in contrast, be arranged above the tractor unit 32, for example. The product mounts 18, 18' are so-to-say configured as a halved common product mount, wherein the product mounts 18, 18' each form a half. The halves are in particular formed symmetrically to a center axis M of the product 10. Due to the compact construction, lateral space requirements are extremely small in this respect.

An option is shown by dashed lines in which the product mount 18 becomes free by a pivoting out to the side. The product mount 18 can be pivoted relative to a pivot axis P which is parallel with respect to the feed direction. It is conceivable that a product mount 18' in this respect always remains in alternating engagement with the product 10 and ensures the advance and/or the stabilization of the product 10, while the other product mount 18 is moved back.

The holders 20, 20' of which one side is shown in FIG. 7 can also reach up to the respective other side and engage into one another, e.g. in the manner of a rake. In this way, an end piece of the product 10 is thus also fixed over the full width when the second product mount 18 is already on the return path against the feed direction Z.

In FIGS. 8A to 8G, an embodiment is shown in which the product mounts 18, 18' can be moved with the aid of linear units which are independent of one another. The holders 20, 20' are in this respect configured adjustable about a pivot axis S which extends perpendicular to the feed direction Z.

Figure 8A:
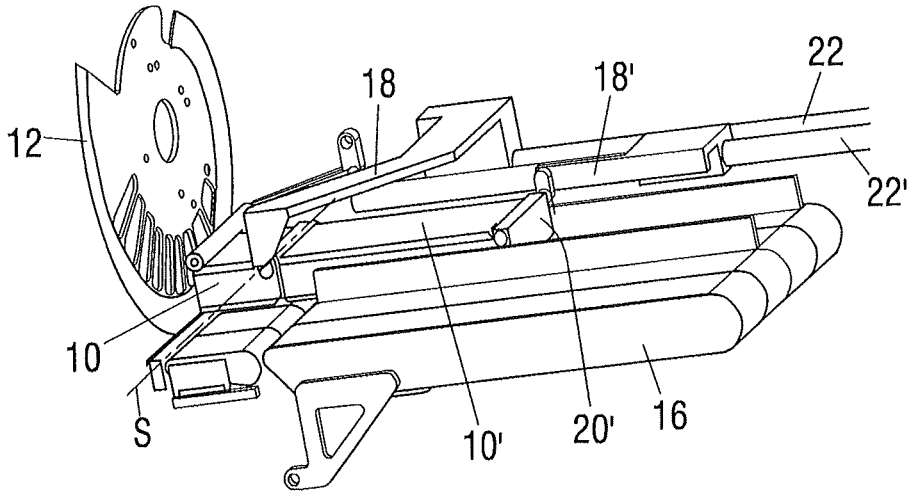

In FIG. 8A a feeding system is first shown in a single-track application. The product mounts 18, 18' are in this respect each associated with a separate guide device 22, 22'. While the product 10 is being sliced, the following product 10' can be loaded and can be gripped by the product mount 18'. The gripping in particular takes place in that the rear product mount 18' pushes the product 10' toward the front product mount 18.

The position of the product start of the following product 10' can be determined on the basis of the power increase at the drive of the rear product mount 18' without an additional sensor system being necessary.

Figure 8B:
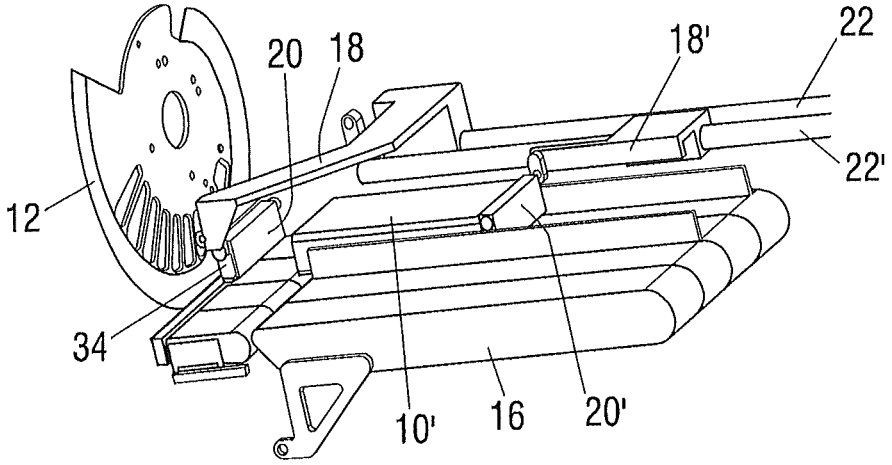

As can be seen in FIG. 8B, the product 10 is sliced until only an end piece 34 remains.

Figure 8C:
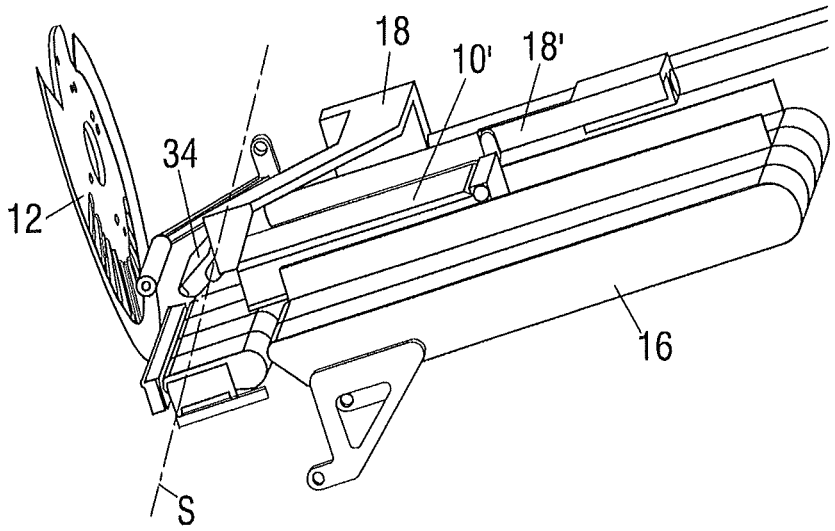

It is shown in FIG. 8C that the end piece 34 is folded upwardly together with the holder 20. If the product 10 is sliced, the product mount 18' in this respect first moves a short bit against the feed direction Z and in this respect pivots upwardly by 90° clockwise about the pivot axis S with the narrow end piece 34. The holder 20 is likewise made narrow and does not impair any possible adjacent tracks.

Already during the pivoting, the following product 10' can be moved forward directly to the cutting blade 10 and can be sliced there.

Figure 8D:
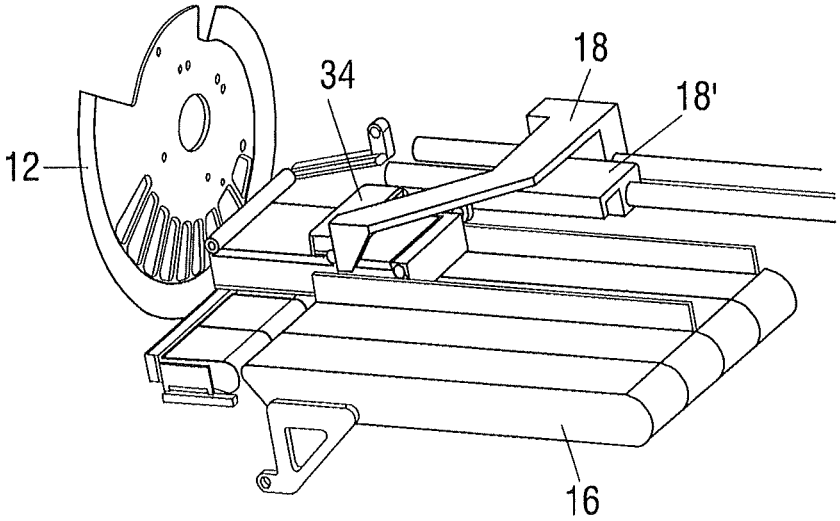

As can be seen in FIG. 8D, the end piece 34 can now be transported by the product mount 18 against the feed direction Z above the following product 10'.

Figure 8E:
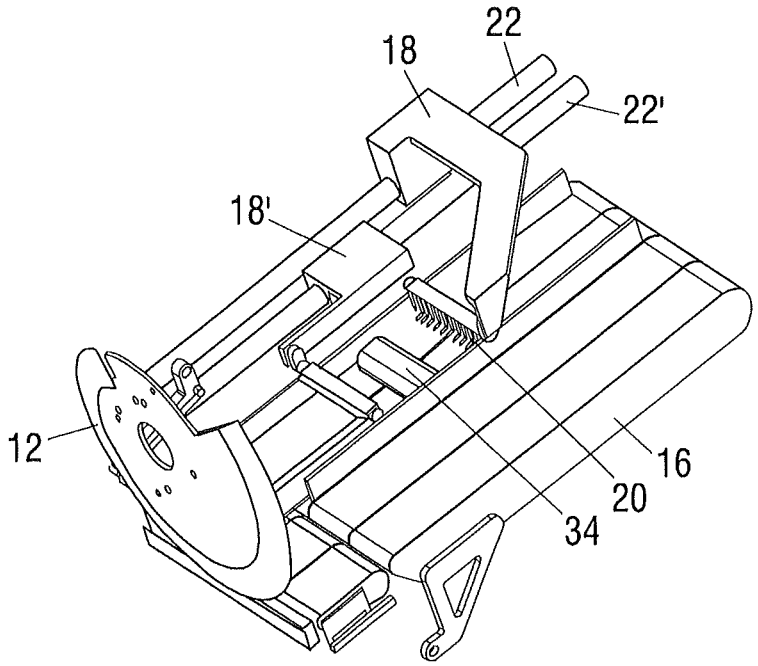

Finally, the end piece, as shown in FIG. 8E, is placed down on the product support 16.

Figure 8F:
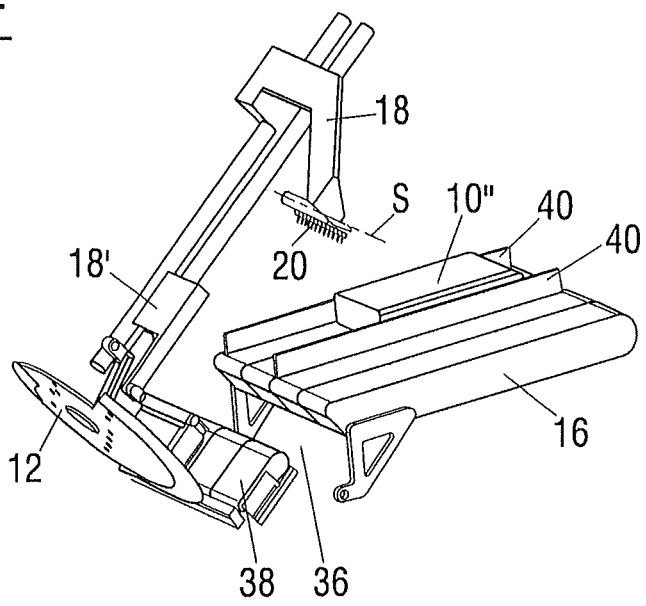

As shown in FIG. 8F, the product support 16 can be lowered into the horizontal for a repeat loading. In this respect, the end piece 34 can be moved to the front in the feed direction Z into a discharge chute 36. A following product 10" can subsequently be inserted into the product support 16. A pivoting of the front short product assist 28 is not required in this respect. The guidance of the products 10, 10', 10" is ensured from above by lateral separation webs 40 of the driven product support 16 as well as of a driven roller.

Figure 8G:
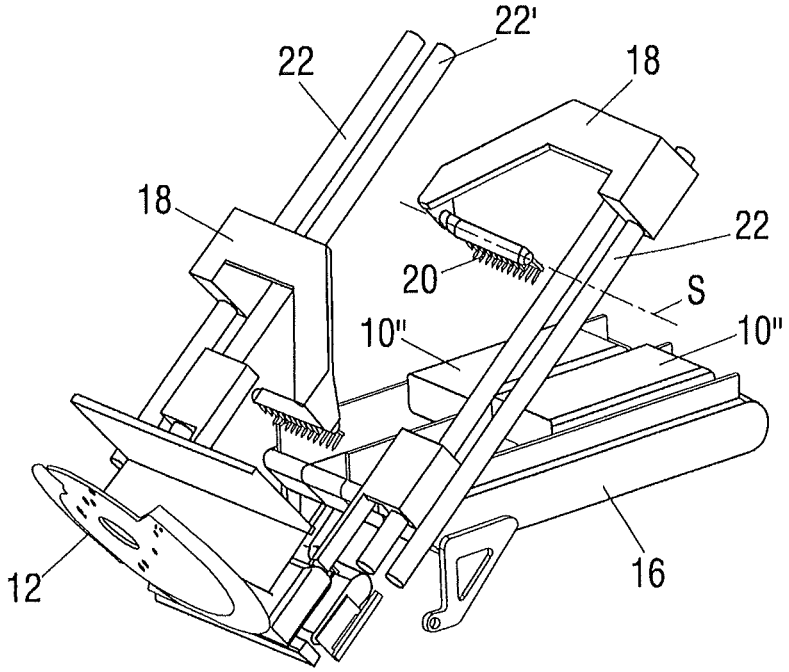

FIG. 8G shows the application of this concept to a multi-track mode of operation. In a two-track mode of operation, four linear drives can be provided, for example. Since the product mounts 18, 18' are each associated with a single track, the feeding apparatus can be expanded by further tracks in any desired modular manner.

In accordance with the invention, a quasi-continuous loading can be achieved so that only short loading pauses result. All the products are also always guided securely.

LIST OF REFERENCE NUMERALS

10, 10', 10" food product
12 cutting blade
14 slicing unit
16 product support, conveyor belt
18, 18', 18" product mount, gripper
20, 20', 20" holder, claw
22, 22' guide device, magnetic track
24, 24', 24" abutment
26 holder, cramp
28, 28', 28" guide means
30 mover
32 tractor unit
34 end piece
36 discharge chute
38 product assist
40 separation web
Z feed direction
A dimension
M center axis
P parallel pivot axis
S perpendicular pivot axis

The invention claimed is:

1. An apparatus for slicing food products comprising:

a product support comprising a plurality of tracks, each of the plurality of tracks for the reception of a plurality of products arranged one after another in a feed direction;

at least two product mounts associated with one of the plurality of tracks and arranged to be spaced from each other in the feed direction, each of the at least two product mounts comprising a holder for holding a rear end of a product viewed in the feed direction and an abutment for a front end of a following product, at least one of the at least two product mounts being adjustable in the feed direction and out of a feed region; and a cutting blade having a cutting plane oriented non-parallel relative to the feed direction of the product, the cutting blade being arranged at an end section of the product support relative to the feed direction, wherein the at least two product mounts are movable relative to each other in the feed direction.

2. The apparatus in accordance with claim 1, wherein at least two product mounts are provided for all of the plurality of tracks.

3. The apparatus in accordance with claim 1, wherein the at least one product mount is configured to fix and/or to determine the position of the following product; and/or wherein the abutment of the at least two product mounts comprising an abutment surface which is planar and/or which corresponds to the shape of the front end of the following product; and/or wherein the at least two product mounts comprise a further holder for holding a front end of the following product.

4. An apparatus for slicing food products comprising:

a product support comprising a plurality of tracks, each of the plurality of tracks for the reception of a plurality of products arranged one after another in a feed direction;

at least two product mounts per track, each of the at least two product mounts spaced from each other in the feed direction of each of the plurality of tracks and comprising a holder for holding a rear end of a product viewed in a feed direction, at least one of the at least two product mounts being adjustable in the feed direction and out of a feed region; and a cutting blade having a cutting plane oriented non-parallel relative to the feed direction of the product, the cutting blade being arranged at an end section of the product support relative to the feed direction, wherein the at least two product mounts can be controlled independently of one another by means of a control, wherein the at least two product mounts each comprise an abutment for a front end of a following product.

5. The apparatus in accordance with claim 4, wherein the at least two product mounts are configured to fix and/or to determine the position of the following product; and/or wherein an abutment of the at least two product mounts comprise an abutment surface which is planar and/or which corresponds to the shape of the front end of the following product; and/or wherein the at least two product mounts comprise a further holder for holding a front end of a following product.

* * * * *